US006264129B1

(12) United States Patent
Robinson

(10) Patent No.: US 6,264,129 B1
(45) Date of Patent: Jul. 24, 2001

(54) MANDREL MOUNT

(75) Inventor: Chris Harrison Robinson, Levittown, PA (US)

(73) Assignee: Free-Flow Packaging International, Inc., Redwood City, CA (US)

( * ) Notice: Subject to any disclaimer, the term of this patent is extended or adjusted under 35 U.S.C. 154(b) by 0 days.

(21) Appl. No.: 09/482,557

(22) Filed: Jan. 13, 2000

Related U.S. Application Data

(62) Division of application No. 09/183,286, filed on Oct. 30, 1998.

(51) Int. Cl.[7] ..... B65H 23/06

(52) U.S. Cl. ..... 242/422.4; 242/422.9; 242/598.3; 242/599.4

(58) Field of Search ..... 242/422.4, 422.9, 242/598.3, 599.4, 156.2

(56) References Cited

U.S. PATENT DOCUMENTS

| | | |
|---|---|---|
| D. 370,920 | 6/1996 | Armington et al. . |
| 510,346 | 12/1893 | Keist . |
| 1,194,249 | 8/1916 | Smith . |
| 1,433,148 | 10/1922 | Parsons . |
| 1,459,241 | 6/1923 | Nordstrom . |
| 2,076,870 | 4/1937 | Taylor . |
| 2,101,170 | 12/1937 | Engel . |
| 2,569,589 | 10/1951 | Trissell . |
| 2,616,633 | 11/1952 | Reynolds . |
| 2,721,709 | 10/1955 | Auerbacher . |
| 2,882,802 | 4/1959 | Walker . |
| 3,069,107 | 12/1962 | Hirt . |
| 3,136,462 | 6/1964 | Knutson . |
| 3,325,120 | 6/1967 | Brinkman . |
| 3,375,995 | 4/1968 | Roman . |
| 3,482,607 | 12/1969 | Villani et al. . |
| 3,509,767 | 5/1970 | Johnson . |
| 3,509,798 | 5/1970 | Johnson . |
| 3,603,216 | 9/1971 | Johnson . |
| 3,613,522 | 10/1971 | Johnson . |
| 3,650,877 | 3/1972 | Johnson . |
| 3,655,500 | 4/1972 | Johnson . |
| 3,799,039 | 3/1974 | Johnson . |
| 4,026,198 | 5/1977 | Ottaviano . |
| 4,045,038 | 8/1977 | Obenshain . |
| 4,085,662 | 4/1978 | Ottaviano . |
| 4,109,040 | 8/1978 | Ottaviano . |
| 4,151,900 * | 5/1979 | Kirwan ..... 242/422.4 X |
| 4,237,776 | 12/1980 | Ottaviano . |
| 4,295,921 | 10/1981 | Bopst, III . |
| 4,327,874 | 5/1982 | Bruno . |
| 4,557,716 | 12/1985 | Ottaviano . |
| 4,601,225 | 7/1986 | Starnes et al. . |
| 4,610,407 | 9/1986 | Stubbmann . |
| 4,650,456 | 3/1987 | Armington . |
| 4,717,613 | 1/1988 | Ottaviano . |
| 4,750,896 | 6/1988 | Komaransky et al. . |
| 4,839,210 | 6/1989 | Komaransky et al. . |

(List continued on next page.)

FOREIGN PATENT DOCUMENTS 45644 9/1908 (CH) .

*Primary Examiner*—Donald P. Walsh
*Assistant Examiner*—Minh-Chau Pham
(74) *Attorney, Agent, or Firm*—Akin, Gump, Strauss, Hauer & Feld, L.L.P.

(57) ABSTRACT

The invention is an apparatus for converting sheets of paper into cushioning dunnage. The apparatus includes a supply assembly, a conversion mechanism, a cutting assembly and a cutting assembly interlock device. The supply assembly supports the paper which is to be converted. The conversion assembly crumples single ply paper into cushioning dunnage and the cutting assembly cuts the newly formed dunnage into desired lengths, where the dunnage is allowed to fall into a container to cushion an item within the container. The cutting assembly interlock device permits activation of the cutting assembly only when the cutting assembly has fully moved into the proper, cutting position.

4 Claims, 10 Drawing Sheets

U.S. PATENT DOCUMENTS

| | | | | |
|---|---|---|---|---|
| 4,884,999 | | 12/1989 | Baldacci . | |
| 4,968,291 | | 11/1990 | Baldacci et al. . | |
| 5,061,543 | | 10/1991 | Baldacci . | |
| 5,107,732 | | 4/1992 | Hanmer . | |
| 5,123,889 | | 6/1992 | Armington et al. . | |
| 5,188,581 | | 2/1993 | Baldacci . | |
| 5,203,517 | * | 4/1993 | Parry et al. | 242/422.4 |
| 5,203,761 | | 4/1993 | Reichental et al. . | |
| 5,211,620 | | 5/1993 | Ratzel et al. . | |
| 5,249,755 | * | 10/1993 | Jespersen | 242/422.4 X |
| 5,322,477 | | 6/1994 | Armington et al. . | |
| 5,327,805 | | 7/1994 | Reichental et al. . | |
| 5,468,208 | | 11/1995 | Armington et al. . | |
| 5,593,376 | | 1/1997 | Armington et al. . | |
| 5,607,383 | | 3/1997 | Armington et al. . | |
| 5,637,071 | | 6/1997 | Simmons et al. . | |
| 5,643,167 | | 7/1997 | Simmons . | |
| 5,645,247 | | 7/1997 | Voigt . | |
| 5,658,229 | | 8/1997 | Armington et al. . | |
| 5,674,172 | | 10/1997 | Armington et al. . | |
| 5,681,255 | | 10/1997 | Simmons . | |
| 5,709,642 | | 1/1998 | Ratzel et al. . | |
| 5,711,142 | | 1/1998 | Cromartie . | |
| 5,711,493 | | 1/1998 | Harris et al. . | |
| 5,713,825 | | 2/1998 | Ratzel . | |
| 5,735,784 | | 4/1998 | Ratzel . | |
| 5,738,621 | | 4/1998 | Simmons . | |
| 5,749,539 | | 5/1998 | Ratzel et al. . | |
| 5,749,821 | | 5/1998 | Simmons . | |
| 5,749,824 | | 5/1998 | Guth . | |
| 5,755,656 | | 5/1998 | Beierlorzer . | |
| 5,769,350 | * | 6/1998 | Oka | 242/422.4 |
| 5,785,639 | | 7/1998 | Simmons . | |
| 5,791,483 | | 8/1998 | Simmons . | |
| 5,803,893 | | 9/1998 | Armington et al. . | |
| 5,884,860 | * | 3/1999 | Ishikawa et al. | 242/422.4 X |
| 5,947,409 | | 9/1999 | Corrigan, Jr. . | |
| 6,076,764 | * | 6/2000 | Robinson | 242/596.7 |

* cited by examiner

MANDREL MOUNT

CROSS-REFERENCE TO RELATED APPLICATION

This application is a divisional application of co-pending U.S. application Ser. No. 09/183,286, filed Oct. 30, 1998.

BACKGROUND OF THE INVENTION

In the process of shipping an item from one location to another, a protective packaging material is typically placed within a shipping container to fill any voids or and/or to cushion the item during shipping. Some conventional materials used are Styrofoam pellets or peanuts, plastic bubble wrap, and padded paper in various forms. One form of protective packaging material, very well known in the art, is paper dunnage provided in strip form from multi-ply, flexible, sheet-like stock material. The edges of the stock material are rolled inwardly and the material is coined or stitched down the center of the strip to form a strip having resilient pillow-like portions. The strip is subsequently cut to a desired length and inserted into the container to cushion the item.

U.S. Pat. No. 5,785,639 (Simmons) is representative of numerous patents directed to relatively complicated machines and methods for producing pillow-like dunnage comprising resilient pillow-like strips. However, such a machine is a relatively complex unit, generally requiring sheets of multi-ply stock paper to be pulled over a forming frame in such a manner as to curl the lateral edges of the sheets toward the middle of the paper, forming pillow-like sections within a paper shell, the paper shell being one of the multi-ply sheets, and then coining or stitching the paper together down the middle to retain the pillow-like shape. Such a machine requires intricately matched gears to simultaneously pull the paper from the roll and coin or stitch the paper into its pillow-like form.

Such machinery is not inexpensive. Although these known machines are suitable primarily for larger-scale productions, they are generally unsuitable for smaller establishments, mail order houses, small shipping departments, individuals and the like. It would be advantageous to provide a dunnage conversion machine which converts stock paper into cushioning dunnage without requiring an expensive and complex conversion machine to perform intricate shaping and coining steps, while still providing an acceptable dunnage product.

The paper which is used to form the packaging dunnage is generally supplied on rolls mounted to a supply end of the dunnage conversion machine. The rolls are generally rotatably supported on a mounting apparatus to facilitate paper supply to the conversion machine. U.S. Pat. No. 5,749,539 (Ratzel et al.) discloses a relatively complex mandrel assembly for mounting a roll of paper onto a mounting frame. A two-piece spindle extends through the length of the paper roll, extending beyond the mounting apparatus. An end of one spindle piece must be inserted through one end of the paper roll and into an opening in an end of the second spindle piece, which must be inserted into a second end of the paper roll to form the spindle. Plugs which are rotatably mounted near each end of the spindle support either end of the paper roll on the spindle. The plugs are retained on the spindle by a plurality of pins that must be inserted diametrically through the spindle to form abutments at opposite axial ends of the plugs. The spindle is then fixed to the mounting frame by additional pins which must be inserted through the spindle into the mounting frame, preventing the spindle from rotating relative to the mounting frame.

As the paper is drawn from the roll, the plugs rotate with the roll and the plugs rotate freely about the fixed spindle. The prior art mandrel assembly does not provide the ability to apply tension to the paper roll except for whatever rotational friction is generated between the spindle and the plugs. Tension is required to reduce paper backlash which may occur when the drive motor is stopped to cut the paper. Excess backlash can separate the paper from the forming mechanism, reducing the forming and shaping capabilities of the machine, producing an unsatisfactory product. It would be advantageous to be able to set a predetermined amount of tension in the paper supply mounting apparatus to prevent or minimize backlash.

After dunnage is formed, it is generally cut into a desired length for use. U.S. Pat. No. 4,699,609 (Komaransky), U.S. Pat. No. 5,327,805 (Reichental et al.), and U.S. Pat. No. 5,569,146 (Simmons), among others, disclose cutting assemblies for cutting a strip of dunnage paper. Generally, after a desired length of dunnage is formed, an operator activates a cutting blade which is located downstream from the forming assembly. The cutting blade travels in a guillotine-like manner to cut the dunnage into strips.

None of the references disclose any type of safety interlock which prevents the cutting blade from activating in the event of a malfunction or the presence of an obstruction, such as a hand. The lack of such an interlock raises serious issues about the safety of such devices in use. It would be advantageous to incorporate into a dunnage conversion machine a cutting blade with a blade interlock to eliminate the possibility of a serious injury in the event of a malfunction or an obstruction in the machine.

The present invention provides a relatively simple apparatus for producing cushioning dunnage, a mandrel for mounting stock paper to the apparatus, and a cutting mechanism with a safety interlock for cutting the dunnage.

BRIEF SUMMARY OF THE INVENTION

The present invention is an apparatus for converting discrete lengths of paper into packaging dunnage. The apparatus comprises a supply assembly which supplies paper to be converted and a conversion mechanism. The conversion mechanism includes a first crumpler located downstream of the supply assembly. The paper is disposed in the first crumpler, which randomly crumples the paper in a first direction as the paper passes through it. The conversion assembly further includes a second crumpler located downstream of the first crumpler. The paper is disposed in the second crumpler, which randomly crumples the paper in a second direction as the paper passes through it. The apparatus further comprises a motor which is drivingly connected to the second crumpler. The second crumpler pulls the paper from the supply assembly, through the first crumpler, and through the second crumpler when the second crumpler is driven by the motor. The apparatus further comprises a cutting assembly located downstream of the conversion mechanism. The paper is disposed in the cutting assembly, with the cutting assembly having a first position wherein the paper passes through the cutting assembly when the motor is driving the second crumpler and a second position wherein the cutting assembly cuts the paper into discrete lengths.

In an alternate embodiment, the invention is an apparatus for converting discrete lengths of paper into packaging dunnage. The apparatus comprises a supply assembly which supplies paper to be converted, the paper including lateral edges. A conversion mechanism including a shaping member is located downstream from the supply assembly. The paper is slidably disposed on the shaping member, which directs the lateral edges of the paper in a first direction. The conversion mechanism further includes a first crumpler located downstream of the shaping member. The paper is disposed within the first crumpler, which crumples the paper in a second direction as the paper passes through the crumpler. The conversion mechanism further includes a second crumpler located downstream of the first crumpler. The paper is disposed within the second crumpler, which crumples the paper in a third direction. A motor is drivingly connected to the second crumpler, which pulls the paper from the supply assembly, past the shaping member, through the first crumpler and through the second crumpler when the second crumpler is driven by the motor. The apparatus further comprises a cutting assembly located downstream of the conversion mechanism. The paper is disposed in the cutting assembly, which has a first position wherein the paper passes through the cutting mechanism when the motor is driving the second crumpler and a second position wherein the cutting assembly cuts the paper into discrete lengths.

The invention comprises a method of converting sheet-like stock paper into dunnage comprising the steps of supplying paper having a longitudinal center and lateral edges; pulling the paper in a path of travel; pulling the paper over a shaping member located downstream from the roll, the shaping member directing the lateral edges of the paper in a first direction; randomly crumpling the paper in a second direction; crumpling the paper in a third direction; and severing the paper into discrete, predetermined lengths after the paper is crumpled in the third direction.

The invention further comprises an apparatus for rotatably supporting a paper roll core on a mount. The paper roll core has a first and second end, a mandrel lock hole located proximate to at least one end, and a longitudinal axis extending therethrough. Paper is wound around the paper roll core. The apparatus further comprises a paper tube plug having a core end and a mounting end, the core end for being positioned within the first end of the paper roll core. The paper tube plug includes an outwardly biased mandrel lock located between the core end and the mounting end of the paper tube plug. The outwardly biased mandrel lock is complementarily positioned on the paper tube plug so that it is aligned with and extends into the mandrel lock hole when the plug is positioned within the end of the paper core roll to rotatably lock the plug to the paper roll core.

The invention further comprises a paper roll core for a roll of stock paper. The paper roll core has a first end and a second end. The core has at least one mandrel lock hole proximate to the first end and at least one mandrel positioning hole located at the first end.

The invention further comprises a combination paper roll core and paper tube plug. The combination comprises a paper roll core including a first and second end and a mandrel lock hole located proximate to the first end. Paper is wound around the paper roll core. The combination further comprises a paper tube plug including a core end and a mounting end. The core end is positioned within the first end of the paper roll core. The paper tube plug includes an outwardly biased mandrel lock located between the core end and the mounting end of the paper tube plug. The outwardly biased mandrel lock is complementarily positioned on the paper tube plug so that it is aligned with and positioned within the mandrel lock hole. The mandrel lock rotatably locks the plug to the paper roll core.

The invention further comprises an apparatus for rotatably supporting a paper roll core on a mandrel mount. The paper roll core has a first and second end, a mandrel handle extending into the first end. The mandrel handle is rotatably fixed to the paper roll core. The mandrel mount applies a predetermined amount of friction against the mandrel handle, the predetermined amount of friction limiting backlash against the at least one mandrel handle.

The invention further comprises a cutting blade interlock apparatus for a cutting blade movable between an open position and a cutting position. The apparatus comprises a first jaw and a second jaw, at least one of the first and second jaws being movable relative to the other of the first and second jaw between a first spaced apart position and a second, closely spaced cutting position. The apparatus further comprises a cutting blade movably mounted between an open position and a cutting position. A cutting blade lock releasably locks the cutting blade in the open position when the first and second jaws are in the first spaced apart position. The cutting blade lock unlocks the cutting blade to permit the cutting blade to move to the cutting position in response to the first and second jaws being in the second, closely spaced position.

The invention further comprises a method of unlocking and relocking a cutting blade in a machine to manufacture dunnage material comprising the steps of drawing together a first jaw and a second jaw, each of the first and second jaws being disposed on an opposite side of the dunnage material, sandwiching the dunnage material therebetween; unlocking a cutting blade in response to the first and second jaws sandwiching the dunnage material therebetween; moving the cutting blade from an open position to a cutting position; returning the cutting blade to the open position; locking the cutting blade in the open position; and separating the first jaw from the second jaw.

The invention further comprises a cutting mechanism for cutting paper in a dunnage machine. The cutting mechanism comprises a first jaw, a second jaw, and a cutting blade pivotally mounted to the first jaw. The cutting blade is operable only when the first jaw is proximate to the second jaw.

The invention further comprises a method of cutting a piece of dunnage material comprising the steps of drawing a first jaw and a second jaw together, sandwiching the dunnage material therebetween; driving a cutting blade from an open position, through the dunnage material, to a cutting position; retracting the cutting blade to the open position; and drawing the first jaw away from the second jaw, releasing the dunnage material.

BRIEF DESCRIPTION OF THE SEVERAL VIEWS OF THE DRAWINGS

The foregoing summary, as well as the following detailed description of the preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
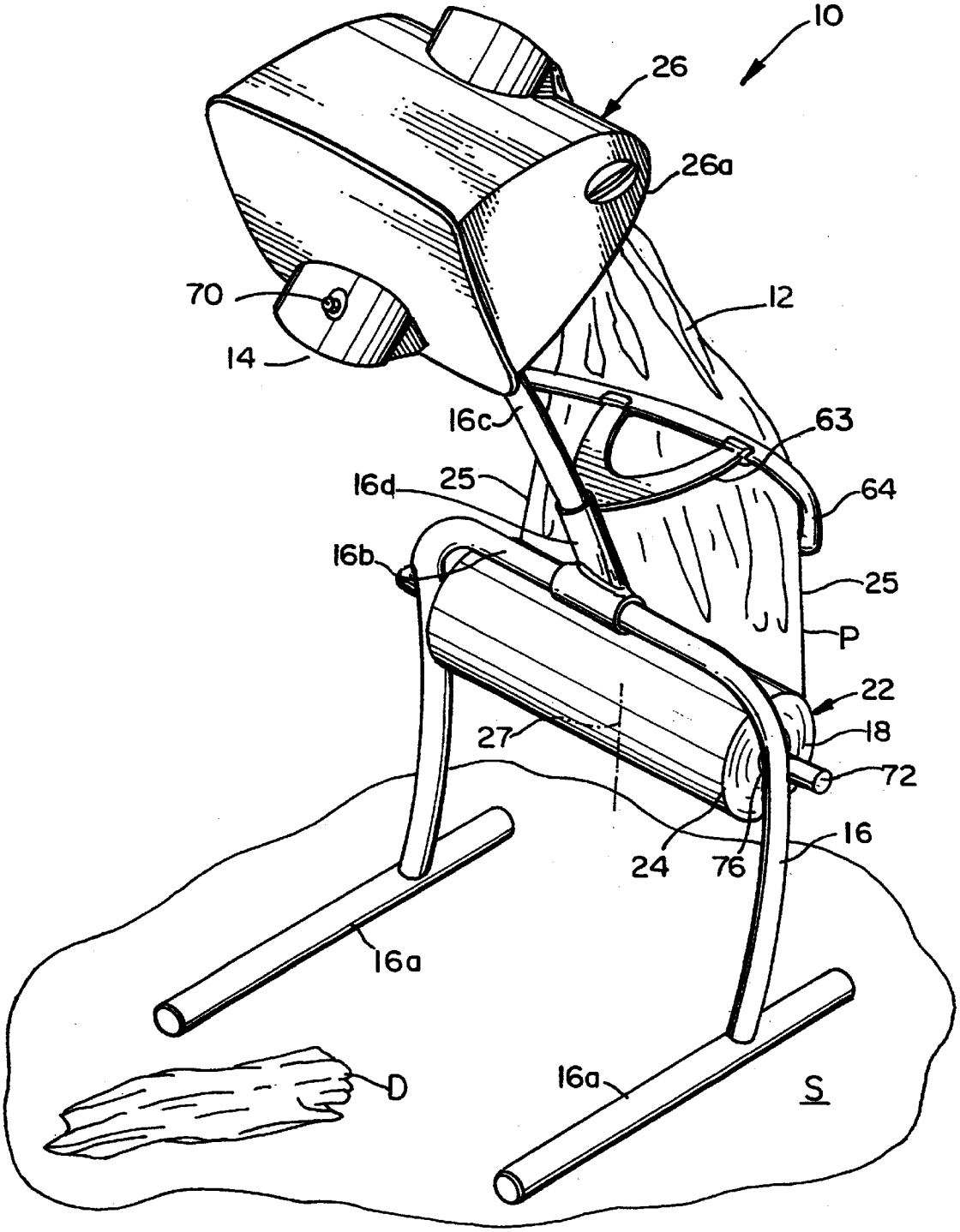
FIG. 1 is a perspective view of a dunnage manufacturing machine of the present invention, viewed from the front.

In the drawings, like numerals are used to indicate like elements throughout.

Figure 2:
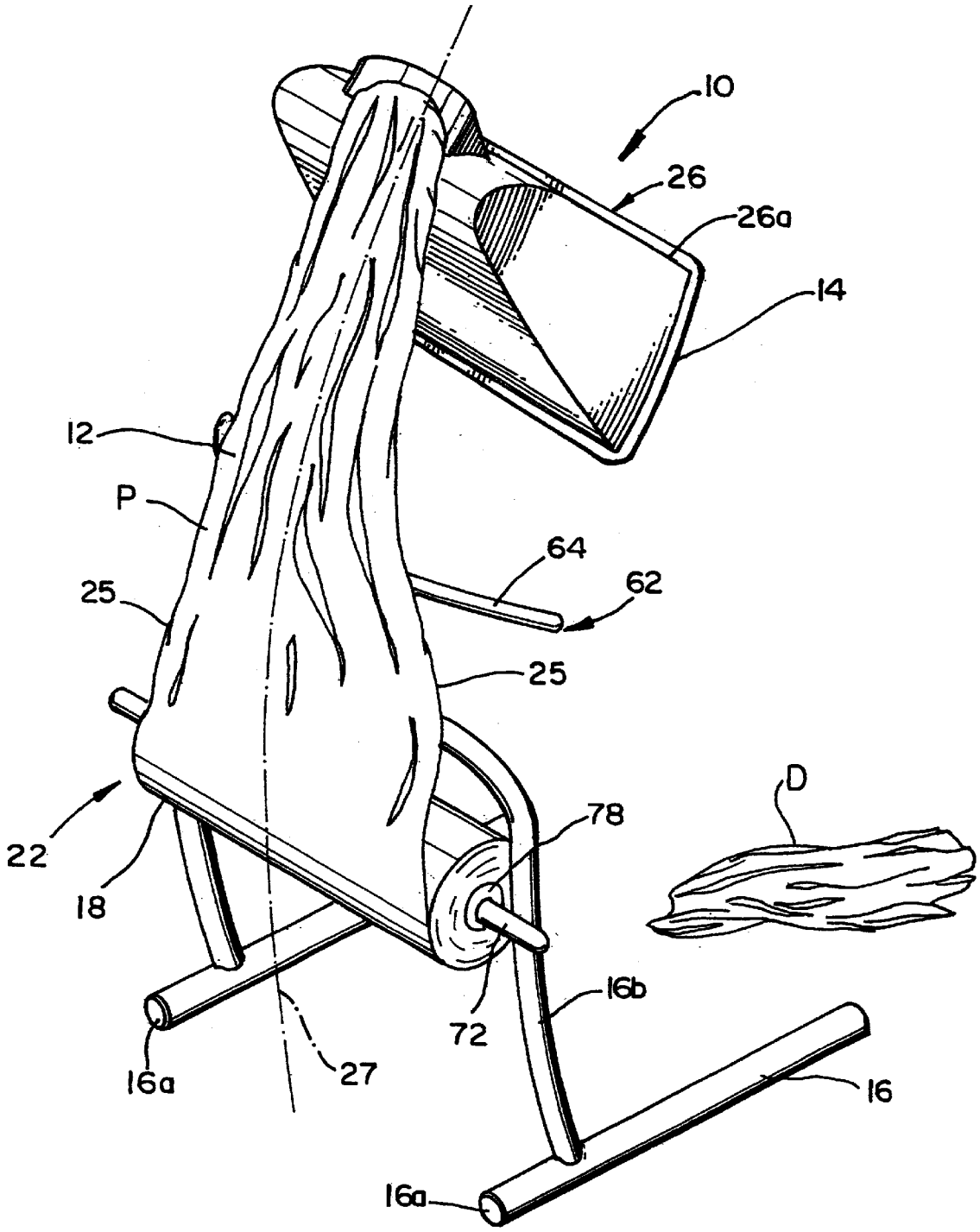
FIG. 2 is a perspective view of the dunnage manufacturing machine, viewed from the rear.
Figure 3:
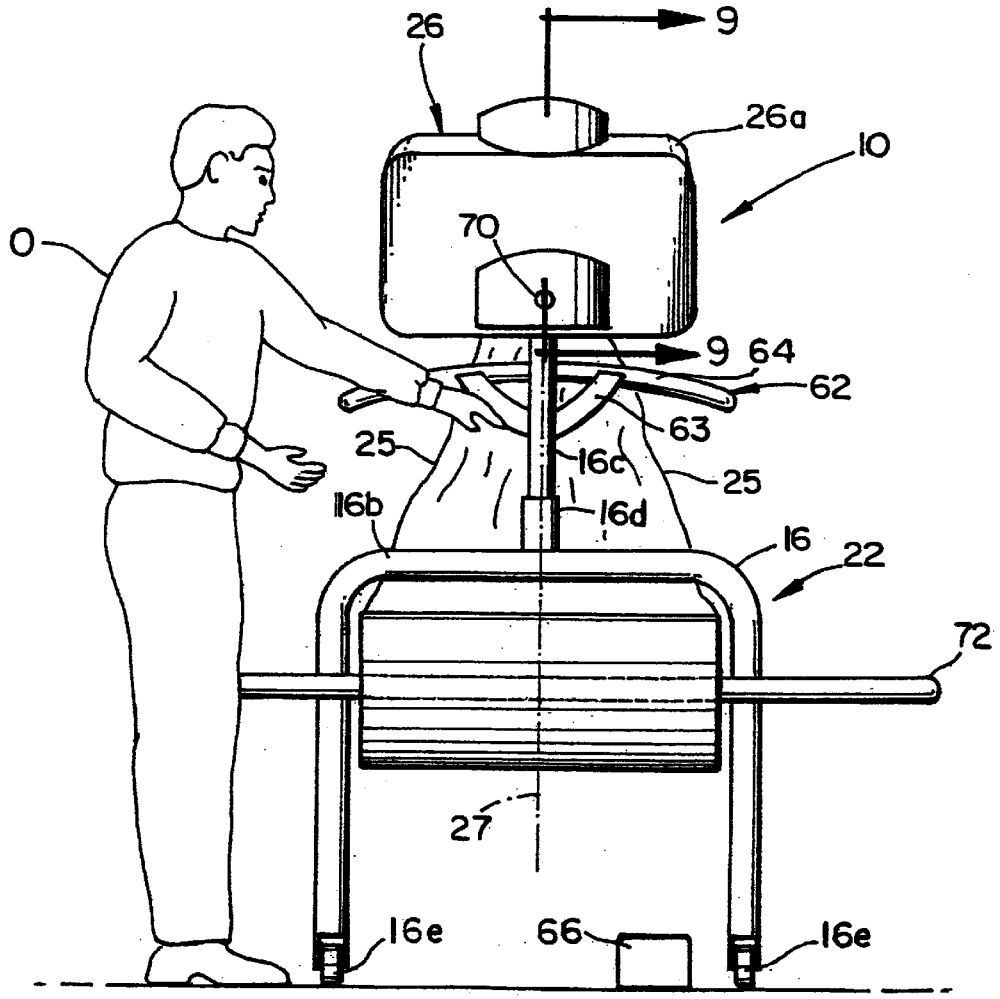
FIG. 3 is a front view of the dunnage manufacturing machine.
Figure 4:
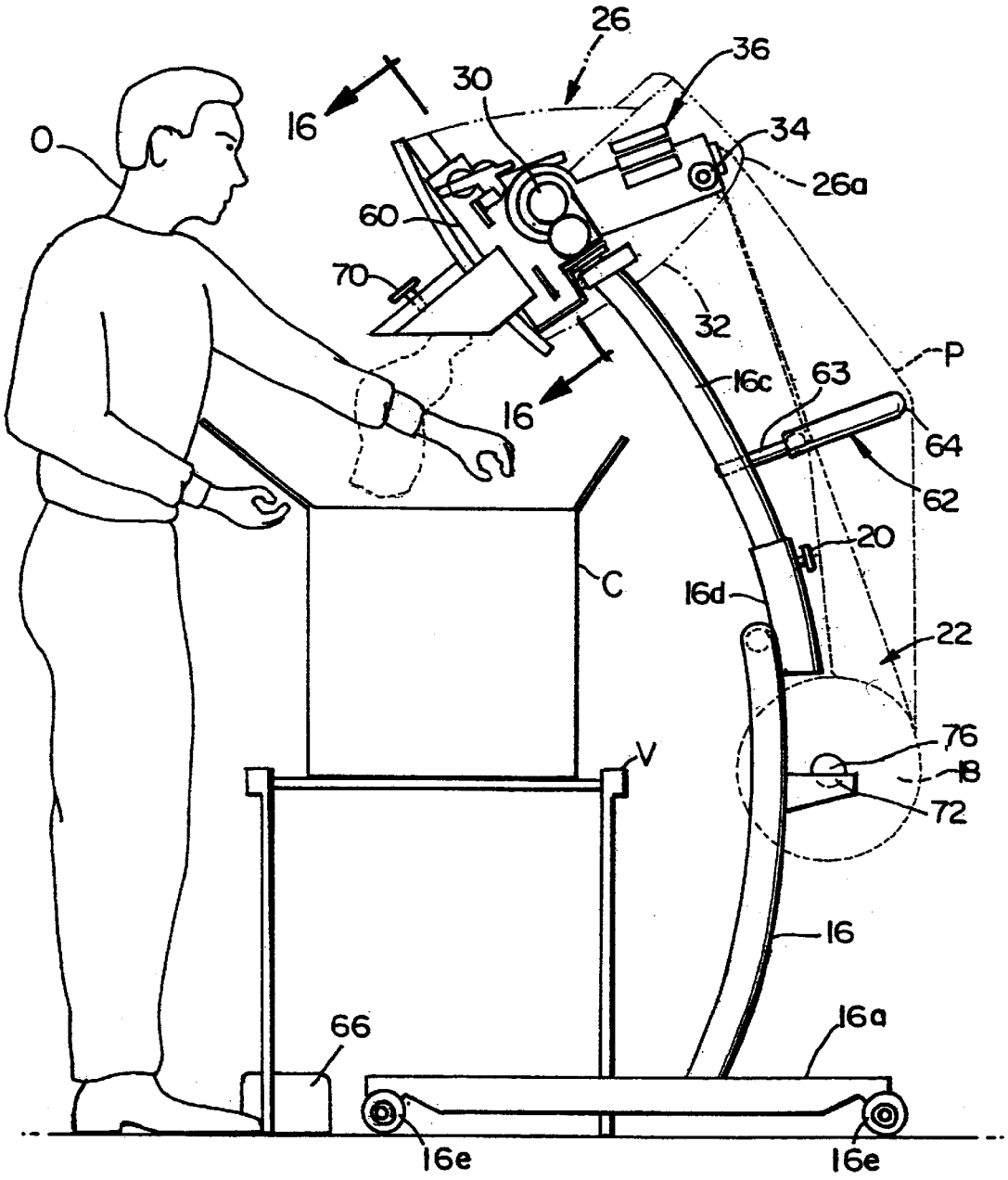
FIG. 4 is a right side view, partially broken away, of the dunnage manufacturing machine.

A dunnage conversion machine 10 for converting discrete lengths of paper into packaging dunnage having a supply end 12 and a dispensing end 14 is shown generally in FIGS. 1–4. The conversion machine 10 converts generally flat paper P into crumpled dunnage paper D for use in cushioning items which are to be placed in a container C for shipping. For purposes of convenience only, and not meaning to be limiting, the dispensing end 14 of the conversion machine 10 is defined herein as the "front" and the supply end 12 is defined herein as the "rear" of the conversion machine 10. FIG. 1 is a perspective view looking from the front and right side and FIG. 2 is a perspective view looking from the rear and left side. FIG. 3 is a front view and FIG. 4 is a view, partially in section, from the right side of the conversion machine 10.

Preferably, the dunnage conversion machine 10 is mounted on a generally inverted Y-shaped frame 16, which is generally vertical. The frame 16 supports the conversion machine 10 at a predetermined height above a floor surface S and also supports a paper roll 18 of paper P at a predetermined height, preferably between the conversion machine 10 and the floor surface S. The frame 16 is preferably of tubular construction made from a metallic material for strength and aesthetics, but the frame 16 can be of any design and material suitable for its purpose. The frame 16 includes a pair of spaced apart feet 16*a* and a generally U-shaped support 16*b* extending upwardly from the feet 16*a*. As shown in FIG. 4, the height of the frame 16 can be adjusted by telescoping the concentrically mounted first and second tubes 16*c*, 16*d* extending from the center of the U-shaped support 16*b* so that the height of the conversion machine 10 above the floor surface S can be adjusted for the convenience of an operator 0. A locking knob 20 is provided for locking the concentrically mounted first and second tubes 16*c*, 16*d* in a particular vertical position in a manner well understood by those of ordinary skill in the art. The operator O generally stands in front of the conversion machine 10, directing cut dunnage product D into a container C and operating the conversion machine 10. As shown in FIGS. 3 and 4, the feet 16*a* may include casters 16*e* at each end thereof to promote the portability of the dunnage conversion machine 10.

Figure 14:
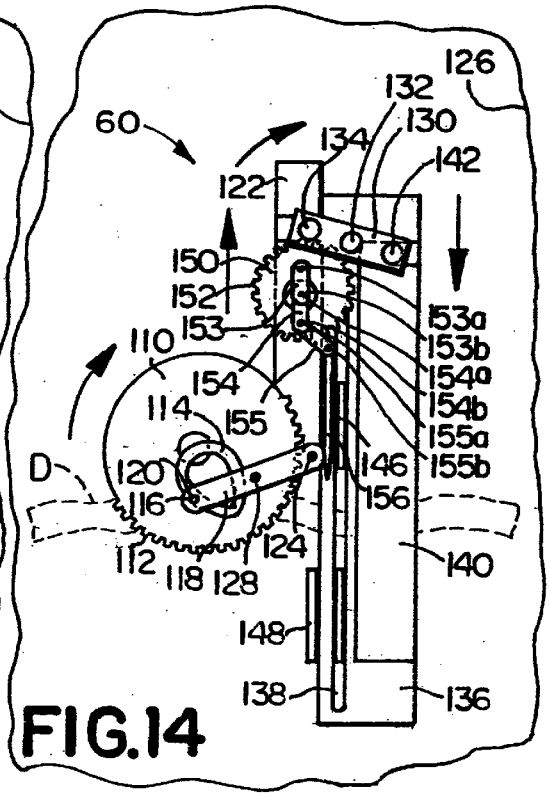

Referring to FIGS. 14, a supply assembly, generally designated 22, supplies paper P to be converted. The paper P is provided as a paper roll 18 of sheet-like stock material and is preferably rolled on a rotatably mounted hollow paper roll core 24, as described in more detail hereinafter. The paper P is preferably single ply Kraft paper with lateral edges 25 and a longitudinal centerline 27, although multiply paper can be used as well. Additionally, the paper P is preferably biodegradable, recyclable, and reusable. Preferably, the length of the paper roll core 24 and the paper supply width are the same, approximately 27" long, although it is recognized by those skilled in the art that paper roll cores and paper of other sizes may be used without departing from the spirit and scope of the invention. Although it is preferred that the paper P used in the conversion machine 10 is rolled paper, it is understood by those skilled in the art that other forms of paper supply, such as fan-folded paper, can be used as the supply of paper P, and the paper supply form as described herein is not meant to be limiting.

Figure 5:
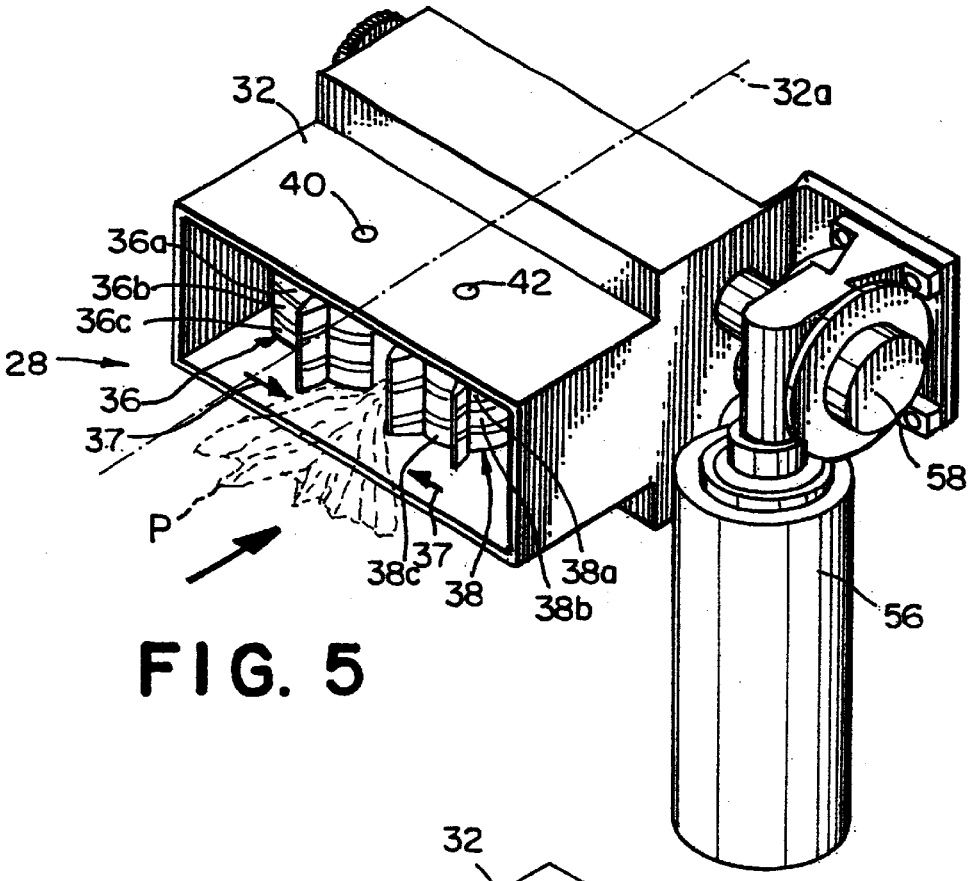
FIG. 5 is a perspective view of the entrance of a first crumpler.
Figure 6:
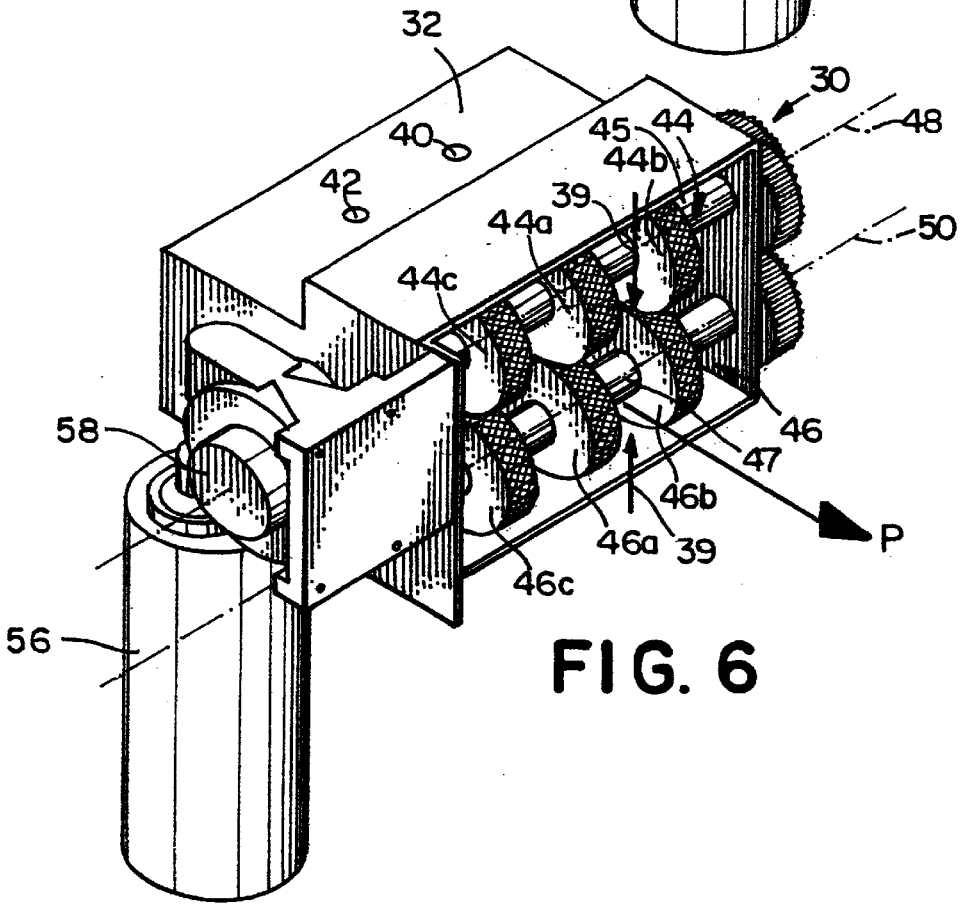
FIG. 6 is a perspective view of the exit of a second crumpler.

Referring now to FIGS. 4–6, a conversion mechanism 26 which converts the supply of paper P into the dunnage product D is mounted on the terminal end of the first tube 16*c* of the frame 16, downstream of the supply assembly 22. The conversion mechanism 26 comprises a first and second crumpler 28, 30 positioned within a removable housing 26*a*. The first and second crumplers 28, 30 are located in a conversion chute 32 for convenience and safety. The conversion chute 32 is mounted to the terminal end of the first tube 16*c* downstream from the supply assembly 22. As shown in FIG. 4, preferably, an entrance roller 34 is located at the entrance to the conversion chute 32 over which the paper P is disposed as it travels into the conversion chute 32.

As shown in FIGS. 14, in the preferred embodiment, the conversion machine 10 includes a shaping member 62 which is mounted to the second tube 16*d* of the frame 16 between the supply assembly 22 and the conversion chute 32 by a U-shaped cantilever beam 63. The shaping member 62 is preferably in the form of an arcuate bar 64, with the open end of the arc facing toward the front of the conversion machine 10. Although it is preferred that the bar 64 be arcuate in shape, it is recognized by those skilled in the art that other shapes and configurations may be used for the shaping member 62. The shaping member 62 directs the lateral edges 25 of the paper P in an inward direction (i.e., the lateral edges 25 move closer together) as the paper P is disposed or pulled over the shaping member 62 to give the paper P a generally arcuate shape.

Referring now to FIG. 5, a first crumpler 28 is located downstream of the supply assembly 22 and shaping member 62 within the conversion chute 32. The paper P is disposed within the first crumpler 28, between first and second wheels 36, 38, which randomly crumples the paper in a first direction, generally indicated by the arrows 37, as the paper P passes through the first crumpler 28. The wheels 36, 38, in addition to providing for crumpling of the paper P, also serve as a safety feature, preventing a person from putting their hand into the entrance to the conversion chute 32 and possibly getting injured. In the preferred embodiment the first and second wheels 36, 38 are paddle wheels. However, it is understood by those of ordinary skill in the art that other wheels could be used, such as wheels with deep tread patterns (not shown), without departing from the spirit and scope of the invention.

Preferably, the first crumpler 28 comprises a first paddle wheel 36 and a second paddle wheel 38 which are closely spaced together but are not quite intermeshed with each other. The paper P is disposed between the first and second paddle wheels 36, 38. Each paddle wheel 36, 38 is rotatably mounted about its own axis 40, 42, respectively. Both axes 40, 42 are located in a plane, preferably perpendicular to a longitudinal center line 32*a* of the conversion chute 32. Neither paddle wheel 36,38 is powered. In the preferred embodiment, the paddle wheels 36, 38 are preferably at least two pairs of paddle wheels superposed over at least one other pair of paddle wheels. More particularly, the first and second paddle wheels 36, 38 are comprised of three independent paddle wheels 36*a*, 36*b*, 36*c*, 38*a*, 38*b*, 38*c*, respectively, located on each axis 40, 42 and stacked co-axially freely to rotate with respect to each other.

The purpose of the first crumpler 28 is to randomly crumple the paper P in a first direction, preferably generally transverse to the plane of the paper P. As such, it is understood by those of ordinary skill in the art from this disclosure that the present invention is not limited to the use of paddle wheels 36, 38 and that other devices could be used to randomly crumple the paper P in the first direction without departing from the spirit and scope of the invention. For instance, the paddle wheels 36, 38 could be intermeshing or a series of horizontally mounted reciprocating pistons (not shown) could be used to crumple the paper P. While the conversion chute 32 is preferably generally rectangular in cross section, it could take many forms, such as frusto-conical (not shown) without departing from the spirit and scope of the invention.

Referring now to FIGS. 4 and 6, the second crumpler 30 is located just downstream of and adjacent to the first crumpler 28, also within the conversion chute 32. Preferably, the second crumpler 30 comprises a first feeding roller 44 and a second, mating feeding roller 46. The paper P is disposed within the second crumpler 30, between the first feeding roller 44 and the second feeding roller 46, which randomly crumples the paper P in a second direction, generally indicated by the arrows 39, as the paper P passes through the second crumpler 30. The second direction is generally perpendicular to the first direction. Each feeding roller 44, 46 is rotatably mounted on its own axis, 48, 50, respectively. Both feeding roller axes 48, 50 are preferably located in the same plane, preferably parallel to the plane of the paddle wheel axes 40, 42, and transverse to the centerline 32*a* of the conversion chute 32. It is understood by those of ordinary skill in the art from this disclosure that the first and second crumplers 28, 30 could be housed in separate units as opposed to both being disposed within the conversion chute 32.

In the preferred embodiment, the first and second feeding rollers 44, 46 preferably include at least one pair of mating feeding wheels 44*a*, 46*a* and, more preferably, at least second and third pairs of adjacent mating feeding wheels 44*b*, 46*b*, 44*c*, 46*c* for pulling the paper P from the supply assembly 22. The feeding wheels 44*a*, 44*b*, 44*c* on the first feeding roller 44 are rotatably fixed to a shaft 45 which is rotatably mounted to the conversion chute 32. Similarly, the feeding wheels 46*a*, 46*b*, 46*c* of the second feeding roller 46 are rotatably fixed to a shaft 47 which is also rotatably mounted to the conversion chute 32. Preferably, the wheels 44*a*, 44*b*, 44*c*, 46*a*, 46*b*, 46*c* are approximately one inch wide and separated from each other on the same axis by approximately one inch. The separation of the pairs of wheels is important to help provide the preferred shape to the dunnage product D. Preferably, the feeding wheels 44*a*, 44*b*, 44*c* of the first roller 44 are separated from the feeding wheels 46*a*, 46*b*, 46*c* of the second roller 46 by a minimum distance to permit the paper P to be fed between the feeding rollers 44, 46, but not to bind the feeding rollers 44, 46 or the paper P as the paper P is pulled through the second crumpler by the feeding rollers 44, 46.

The outer circumference of the feeding wheels 44*a*–44*c*, 46*a*–46*c* is knurled to provide additional gripping strength to pull the paper P between the first and second rollers 44, 46. Although, preferably, three pairs of feeding wheels 44*a*–44*c*, 46*a*–46*c* are used on each feeding roller 44, 46, respectively, and each feeding wheel 44*a*–44*c*, 46*a*–46*c* is approximately one inch wide with a one inch space between adjacent pairs of feeding wheels 44*a*–44*c*, 46*a*–46*c*, it is understood by those skilled in the art that more or less than three feeding wheels can be used, and that each feeding wheel can be more or less than one inch in width, with more or less than one inch separating adjacent wheels (not shown), without departing from the spirit and scope of the invention. The feeding wheels 44*a*–44*c* of the first roller 44 are preferably constructed of metal, whereas the feeding wheels 46*a*–46*c* of the second roller 46 are preferably constructed of rubber.

Still referring to FIG. 6, a drive motor 56 is drivingly connected to the second crumpler 30 such that, when the second crumpler 30 is driven by the drive motor 56, the second crumpler 30 pulls the paper P from the supply assembly 22, past the shaping member 62, through the first crumpler 28, and through the second crumpler 30. In the preferred embodiment, the drive motor 56 is connected to the second crumpler 30 via a worm gear drive 58, although those skilled in the art will realize that the drive motor 56 can be connected to the second crumpler 30 directly, via a belt drive, or other drives known in the art. Further, in the preferred embodiment, the drive motor 56 is an electric motor, although it is understood by those skilled in the art that other types of motors, such as pneumatic motors, hydraulic motors, or any other type of motor suitable for such an application may be used to drive the second crumpler 30. When the second crumpler 30 is a pair of first and second feeding rollers 44, 46, the drive motor 56 can be connected to one of the first and second feeding rollers 44, 46, and the connected feeding roller can be further connected to the other of the first and second feeding rollers by a gear drive, a belt drive, or other drives known in the art.

While it is preferred that the second crumpler 30 include a pair of first and second feeding rollers 44, 46, it is understood by those skilled in the art that the second crumpler 30 can be something other than a pair of feeding rollers 44, 46, such as a set of wheels having spokes extending therefrom (not shown). Additionally, while the paddle wheels 36, 38 are described as having paddle wheel axes 40, 42 perpendicular to a centerline of the conversion chute 32, and the feeding rollers 44, 46 are described as having feeding roller axes 48, 50 in a plane parallel to the plane of the paddle wheel axes 40, 42, it is understood by those skilled in the art that the axes can be located in other planes as well, without departing from the spirit and scope of the invention. For instance, the planes of the paddle wheel axes 40, 42 and roller axes 48, 50 could be at forty-five degrees with respect to each other. Moreover, it is preferred that the first and second feeding rollers 44, 46 be mounted for easy separation (not shown) to facilitate access if the paper P becomes jammed therebetween.

Referring back to FIG. 4, a cutting assembly, generally denoted as 60, and described in detail below, is located downstream of conversion mechanism 26. The paper P is disposed in the cutting assembly 60 as it exits the second crumpler 30. The cutting assembly 60 has two positions, a first position where the paper P, now converted to dunnage D passes through the cutting assembly 60 when the drive motor 56 is driving the second crumpler 30, and a second position wherein the cutting assembly 60 cuts the dunnage D into discrete lengths.

Referring now to FIGS. 1–6, the shaping of the paper P into dunnage D is now discussed. To load the conversion machine 10, approximately six to eight feet of paper P from the paper roll 18 is unwrapped from the roll 18 and stretched over the shaping member 62. The general configuration of the shaping member 62 forces the longitudinal center 27 of the paper P outward and upward relative to the direction of travel of the paper P. This pushing out of the longitudinal center 27 of the paper P forces the lateral edges 25 of paper P to pinch inward. The paper P, now in a generally U-shaped configuration in cross section, is fed into the conversion chute 32, over the entrance roller 34. The paper P is then hand fed between the paddle wheels 36, 38. The paddle wheels 36, 38 force the lateral edges 25 of the paper P together, compressing the paper P in between the lateral edges 25 and crumpling the paper P in the first direction. The paper P is then fed between the first and second feeding rollers 44, 46 where it is pinched between the first and second feeding rollers 44, 46 and further compressed in a horizontal plane, crumpling the paper P in a second direction, generally perpendicular to the second direction. The paper P, now compressed in dunnage form D, is passed through the cutting assembly 60. The conversion machine 10 is now ready for operation.

To operate the conversion machine, an operator O then presses a foot switch 66 which starts the drive motor 56. The drive motor 56 is drivingly connected to the first and second feeding rollers 44, 46 which pull the paper P from the paper roll 18 in a path of travel. The feeding rollers 44, 46 pull the paper P from the paper roll 18 and over the shaping member 62 located downstream from the paper roll 18. The shaping member 62 directs the lateral edges 25 of the paper P in a first direction, generally inward. At the same time, the shaping member 62 directs the longitudinal center 27 of the paper P away from the path of travel. Preferably, the shaping member 62 directs the longitudinal center 27 of the paper P upward and outward from the center of the conversion machine 10. However, it is obvious to those skilled in the art that the longitudinal center 27 of the paper P can be directed in other directions, including, but not limited to, downward and inward toward the center of the conversion machine 10. As the paper P is being pulled over the shaping member 62, the shaping member 62 directs the lateral edges 25 of the paper P inwardly. The paper P is then pulled by the first and second feeding rollers 44, 46 between the paddle wheels 36, 38, randomly crumpling the paper P in a first direction, preferably generally transverse to the longitudinal center 27 of the paper P. As the paper P passes between the first and second feeding rollers 44, 46, the paper P is crumpled in a second direction. Preferably, the crumpling in the second direction is a random crumpling, and is generally in a direction perpendicular to the first direction. After the paper P is crumpled in the second direction, and a desired amount of dunnage D has been formed, the operator O releases the foot switch 66, stopping the drive motor 56 and severing the dunnage D into discrete, predetermined lengths. Preferably, after the dunnage D is severed, it is allowed to fall directly into the container C, to pad an item placed in the container C for transport.

Preferably, the foot switch 66 is operatively connected to the drive motor 56 and depression of the foot switch 66 operates the drive motor 56. Releasing of the foot switch 66 stops the drive motor 56 and automatically energizes a cutting motor 68, as described in more detail below. However, those skilled in the art will realize that other types of start/stop mechanisms, such as push buttons, toggle switches, or other mechanisms known in the art, whether manually activated or voice activated, may be used in place of the foot switch. Further, in the event of an emergency, an emergency stop actuator 70 is located proximate to and within easy reach of the operator O, enabling the operator O to stop the drive motor 56 without activating the cutting motor 68, see FIG. 3.

Figure 7:
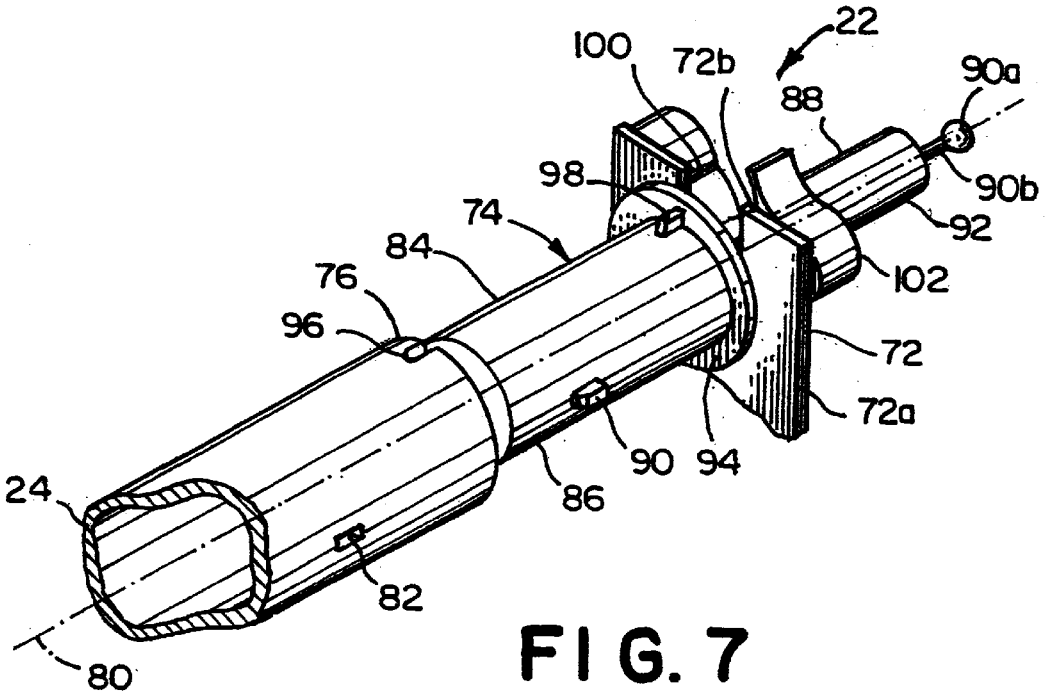
FIG. 7 is a perspective view of a core end of a mandrel handle of the dunnage manufacturing machine.
Figure 8:
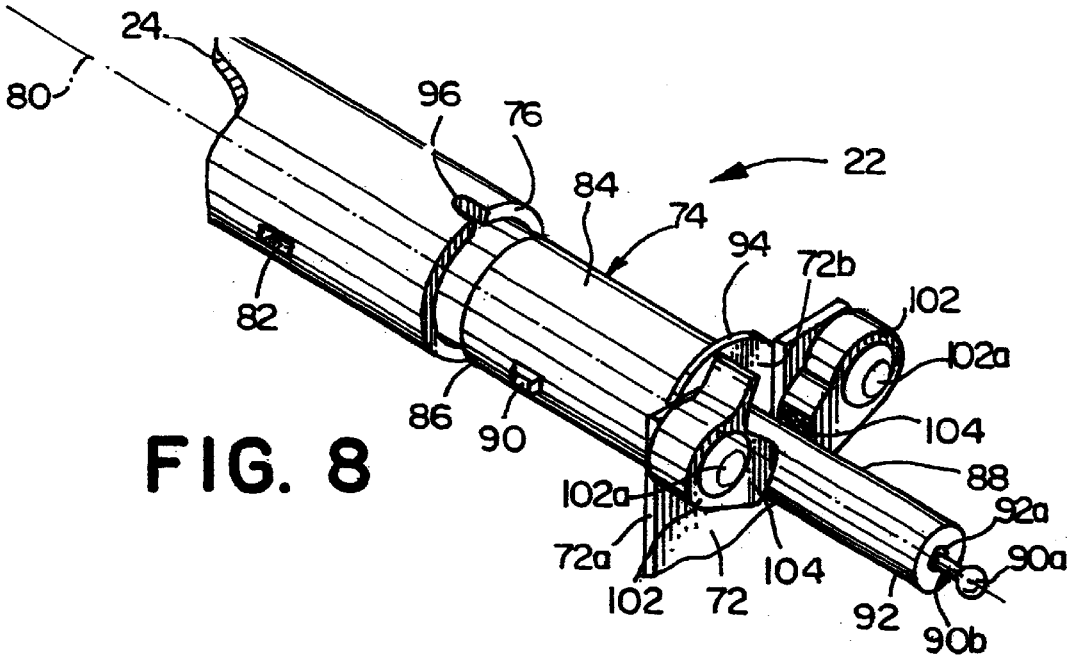
FIG. 8 is a perspective view of a mounting end of the mandrel handle inserted in the mandrel mount.

Referring now to FIGS. 2, 7 and 8, the paper roll core 24 is rotatably mounted in the frame 16 by a mandrel mount 72. The mandrel mount 72 is located on the frame 16, upstream of the conversion mechanism 26, and is in the form of a pair of plates 72*a* having a slot 72*b* therein located on both sides of the U-shaped support 16*b*. The paper roll core 24 is mounted on the mandrel mount 72 by means of a pair of mandrel assemblies 74, with one mandrel assembly 74 on each longitudinal side of the paper roll 18 (only one mandrel assembly is shown in FIGS. 7 and 8). The paper roll core 24 has a first end 76, a second end 78 and a longitudinal axis 80 extending therethrough. At least one mandrel lock hole 82 is located on the paper roll core 24 proximate to at least one of the first and second ends 76, 78. In the preferred embodiment, the paper roll core 24 also has one mandrel lock hole 82 proximate to both the first and the second ends 76, 78 of the paper roll core 24. The mandrel hole lock 82 preferably extends completely radially through the paper roll core 24, but it could extend only partially therethrough to create a depression, without departing from the spirit and scope of the invention. The paper P to be converted is wound around the paper roll core 24 in a manner well understood by those of ordinary skill in the art.

Each mandrel assembly 74 includes a paper tube plug 84 having a core end 86 and a mounting end 88, with the core end 86 for being complementarily positioned within the first or second end 76, 78 of the paper roll core 24. The paper tube plug 84 further includes a spring loaded radially outwardly biased mandrel lock 90 which is located on the core end 86 of the paper tube plug 84. The outwardly biased mandrel lock 90 is complementarily positioned on the paper tube plug 84 so that it is aligned with and extends into the mandrel lock hole 82 on the paper roll core 24 when the paper tube plug 84 is positioned and aligned within the end 76 of the paper roll core 24. The mandrel lock 90 rotatably locks the paper tube plug 84 to the paper roll core 24.

A mandrel handle 92, in the form of a cylindrical shaft, is fixedly attached to or forms a part of the mounting end 88 of the paper tube plug 84. The mandrel handle 92 is co-axial with the longitudinal axis 80 of the paper roll core 24 and extends away from the paper roll core 24 along the longitudinal axis 80. The mandrel handle 92 rotatably supports the paper roll 18 on the mandrel mount 72. The paper tube plug 84 further comprises a stop plate 94 which is positioned between the outwardly biased mandrel lock 90 and the mandrel handle 92. The stop plate 94 serves as a bearing surface to retain the paper roll 18 between each end of the mandrel mount 72 and to control the distance that the core end 86 is inserted into the paper roll core 24.

The paper roll core 24 includes a mandrel positioning hole or notch 96 located at each distal end of the paper roll core 24. The paper tube plug 84 includes a mandrel positioning stop 98 located between the outwardly biased mandrel lock 90 and the stop plate 94. The mandrel positioning stop 98 is selectively positioned on the paper tube plug 84 so that, when the mandrel positioning stop 98 is within the mandrel positioning hole 96, the mandrel lock 90 is aligned with and positioned within the mandrel lock hole 82. The position of the mandrel lock 90 is controlled by the position of a knob 90*a* reciprocally mounted to the end of the mandrel handle 92. A shaft 90*b* extends from the knob 90*a* through a bore 92*a* in the mandrel handle 92 into the hollow interior of the paper tube plug 84. The shaft 92*b* interacts with a spring (not shown). Movement of the knob 90*a* toward and away from the mandrel handle 92 causes the mandrel lock 90 to move between the extended position shown in FIGS. 7 and 8 where the mandrel lock 90 extends radially outwardly from the core end 86 and a retracted position (not shown) where the mandrel lock is retracted into the core end 86 below the external surface of the core end 86.

In use, each paper tube plug 84 is inserted into the first and second ends 76, 78 of the paper roll core 24. The knob 90*a* is positioned to move the mandrel lock 90 to the retracted position to permit the core end 86 to fit within the first and second ends 76, 78 of the paper roll core 24. The mandrel positioning stop 98 is then aligned with and inserted into the mandrel positioning hole 96. Because the mandrel hole lock 82 is not readily viewable when the paper P is on the paper roll core 24, the location of the mandrel positioning hole 96 and the mandrel positioning stop 98 blindly aligns the mandrel lock 90 with the mandrel lock hole 82. Once alignment occurs, the mandrel lock 90 is biased outward into the mandrel lock hole 82 by movement of the knob 90*a*. Thus, the outwardly biased mandrel lock 90 extends into the mandrel lock hole 82, locking the paper tube plug 84 onto the paper roll core 24. While it is preferred that two locking paper tube plugs 24 be used, it is understood by those of ordinary skill in the art from this disclosure that only one locking tube plug need be used, the other plug would not need to be rotatably locked to the paper tube core 24. The mandrel handles 92 which extend from each paper tube plug 84 allow the operator O to lift the paper roll 18 at either end to transport the paper roll 18 and to install it onto the supply assembly 22.

While in the preferred embodiment, it is preferred that the paper tube plugs 84 be rotatably locked into the paper roll core 24 via the mandrel lock hole 82 and mandrel positioning hole 96 in combination with the mandrel lock 90 and the positioning stop 98, it is understood by those of ordinary skill in the art that the paper tube plug 84 could be rotatably locked to the paper roll core 24 with just the mandrel positioning hole 96 and mandrel positioning stop 98 or the paper roll core 24 and the mounting end 86 of the paper tube plug 84 could be splined (not shown) in a complementary manner to rotatably lock the same together, without departing from the spirit and scope of the invention.

After both paper tube plugs 84 are inserted into the paper roll core 24, the mounting end 88 of the paper tube plug 84 is placed into the respective slot 72*b* on the mandrel mount 72 on either end of the supply assembly 22. The supply assembly 22 rotatably supports the paper roll 18 on the mandrel mount 72 at the mandrel handle 92. At least one, and preferably both, plates 72*a* of the mandrel mount 72 apply a predetermined amount of friction against the mandrel handle 92. The predetermined amount of friction produces tension in the mandrel assembly 74 as the paper P is drawn through the conversion machine 10. It is important to apply tension to the mandrel assembly 74 to prevent continued rotation of the paper roll 18 when the drive motor 56 is stopped to cut a strip of formed dunnage paper D. Without the tension, the paper roll 18, through its own inertia, will have a tendency to continue rotating about the mandrel assembly 74, creating a condition known as backlash. The backlash unwinds paper P from the paper roll 18 as the paper roll 18 rotates. The unwound paper P may have a tendency to sag at some point between the paper roll 18 and the conversion chute 32, negating the effect of the shaping member 62, and adversely affecting the shaping and crumpling capability of the dunnage conversion machine 10.

At least one, and preferably two, jam cleats 102 are movably, or more preferably pivotally, mounted on each plate 72*a* via a pintle 102*a* to apply the tension required to eliminate the backlash. The jam cleats 102 are biased against the mandrel handle 92 after the mandrel handle 92 is inserted into the mandrel mount 100 to apply friction to the mandrel handle 92. A spring (not shown) is mounted between the jam cleat 102 and the plate 72*a* to achieve the necessary biasing action. The jam cleats 102 further comprise a gripping friction pad 104 which engages the mandrel handle 92 to apply tension to the paper roll 18 during operation via friction. The jam cleats 102 are biased in opposite directions toward each other, such that when the handle 92 is removed, the gripping pads 104 engage each other.

While it is preferred that tension be applied to the paper roll 18 via the jam cleats 102, it is understood by those of ordinary skill in the art from this disclosure that other methods could be used for applying tension to the paper roll 18 to prevent backlash. For instance, the slots 72*b* formed in the plates 72*a* could be coated with an ultra high molecular weight polyethylene (commonly known as a UHMW) (not shown) that would inhibit the rotation of the mandrel handles 92 therein, without departing from the spirit and scope of the invention.

Figure 9:
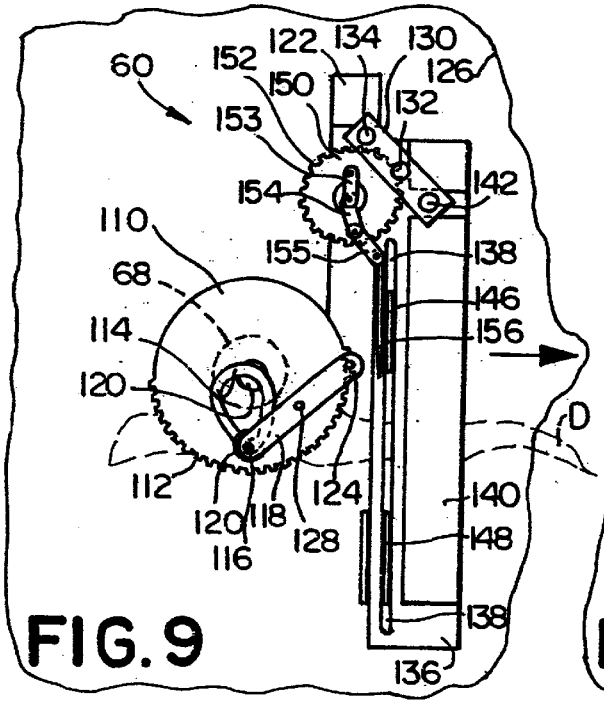
FIGS. 9–15 are enlarged partial cross-sectional views taken along lines 9—9 of FIG. 3 showing the sequential operation of a cutting mechanism.

The cutting assembly 60 is located at the outlet of the conversion mechanism 26 and is described as follows. As shown in FIG. 9, a cam 110 is rotatably mounted to the cutting motor 68 (shown in phantom). A plurality of gear teeth 112 are mounted on the outer circumference of the cam 110 approximately one-half the way around the cam 110. Preferably, the gear teeth 112 extend approximately 210° around the outer circumference of the cam 110. A cam slot 114 which is approximately eggshaped is eccentrically cut in the cam 110. A cam follower 116 is fixedly mounted to a cam arm 118 at a first end 120 and is located in the cam slot 114 to follow the cam slot 114 as the cam 110 rotates. An upper jaw mount 122 is pivotally attached to the cam arm 118 at a second, distal end 124. The upper jaw mount 122 is mounted for reciprocal linear motion, as described in more detail below. The cam arm 118 is pivotally mounted to a side wall 126 of the conversion chute 32 about a cam pivot 128 located on the cam arm 118 between the first end 120 and the second end 124. The cam pivot 128 is preferably, but not necessarily, located near the longitudinal center of the cam arm 118. A lever 130 is pivotally mounted to the side wall 126 of the conversion assembly 32 at a lever pivot 132 and pivotally attached to the upper jaw mount 122 at a first end 134. A jaw mount frame 136, having a linear slot 138 therein, is mounted within the conversion chute 32. The upper jaw mount 122 is slidably attached to the jaw mount frame 136 via the slot 138. A lower jaw mount 140 is pivotally attached to the lever 130 at a second lever end 142, distal from the first end 134. The lower jaw mount 140 is mounted for reciprocal linear motion on the jaw mount frame 136 via slot 138. An upper jaw 146 is fixedly attached to the upper jaw mount 122. A lowerjaw 148 is fixedly attached to the lower jaw mount 140. A portion of the upper and lower jaws 146, 148 is positioned within the slot 138 to constrain the motion of the upper and lower jaws 146, 148 to be substantially linear. The upper and lower jaws 146, 148 are movable relative to the other between a first, spaced apart position (shown in FIG. 9), and a second, closely spaced cutting position (shown in FIG. 10), wherein the paper P is disposed between the upper and lower jaws 146, 148. The upper and lower jaws 146, 148 are biased to the closed position by a spring (not shown).

A cutting blade drive gear 150 is rotatably mounted to the upper jaw mount 122 such that the cutting blade drive gear 150 rotates with respect to the upper jaw mount 122 but yet moves linearly with the upper jaw mount 122. The cutting blade drive gear 150 has gear teeth 152 spaced about the entire outer circumference of the cutting blade drive gear 150 which are drivingly engageable with the gear teeth 112 on the cam 110.

A first link 153 has a first end 153*a* secured to the center of the cutting blade drive gear 150 for rotation therewith. A first end 154*a* of the pivoting cutting blade drive shaft 154 is rotatably mounted to a second end 153*b* of the first link 153. A second end 154*b* of the pivoting cutting blade drive shaft 154 is rotatably connected to a first end 155*a* of a second link 155. A second end 155*b* of the second link 155 is rotatably fixed to the upper end of a cutting blade 156. Thus, the second link 155 is fixed to the cutting blade 156. The cutting blade 156 is mounted on the upper jaw mount 122 for reciprocal linear motion with respect thereto. The cutting blade 156 is biased to the open position by a spring (not shown).

Figure 10:
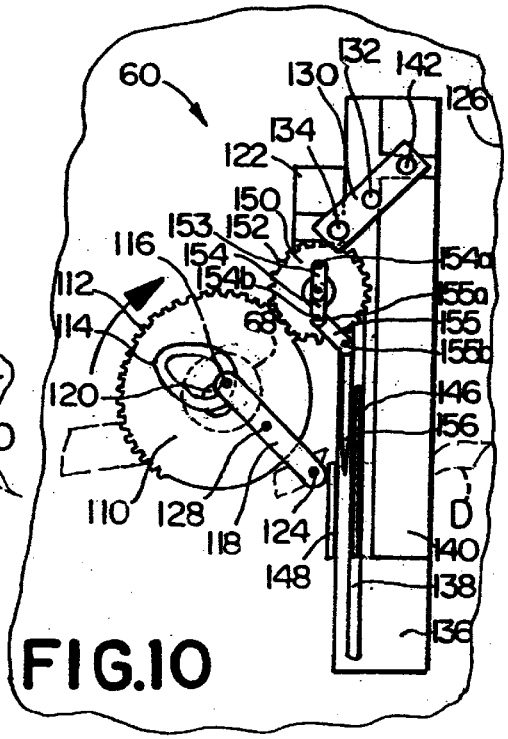

When the upper and lower jaws 146, 148 are in the first, spaced apart position as shown in FIG. 9, the cutting blade drive gear teeth 152 are not engaged with the cam gear teeth 112. The cutting blade drive gear teeth 152 are only engaged with the cam gear teeth 112 when the upper and lower jaws 146, 148 are in the second, closely spaced cutting position, as shown in FIG. 10. As a result, the cutting blade 156 is operable only when the upper and lower jaws 146, 148 are in the second, closely spaced position, as described in more detail hereinafter. The cutting blade 156 is, thus, movably mounted between an open position and a cutting position.

The operation of the cutting assembly will now be described. The conversion machine 10 produces the dunnage product D as described above in response to the operator O activating the foot switch 66. The dunnage paper D passes between the upper and lower jaws 146, 148 as shown by the arrow in FIG. 9. When the operator O releases the foot switch 66, the cutting motor 68 is automatically activated. Preferably, the cutting motor 68 rotates exactly one revolution in a clockwise direction looking from the left side of the conversion machine 1O. The cam 110, which is fixedly attached to the output of the cutting motor 68, also rotates exactly one revolution in a clockwise direction. Although, in the preferred embodiment, the cam 110 is directly attached to the cutting motor 68, it is well known by those skilled in the art that the cam 110 can be connected to the cutting motor 68 by other means, such as by gears or a belt drive, for example, and the cutting motor 68 need not necessarily be fixedly attached to the cam 110, as long as the cam 110 rotates exactly one revolution.

As shown in FIG. 10, the rotation of the cam 110 initially drives the cam follower 116, and, as a result, the cam arm 118, in a clockwise direction. This clockwise rotation drives the second end 124 of the cam arm 118 in a downward motion. The downward motion of the second end 124 of the cam arm 118 draws the upperjaw mount 122 and upper jaw 146, guided by slot 138, in a downward direction. The downward motion of the upper jaw mount 122 activates lever 130, pivoting the lever 130 about pivot pin 132, driving the first end 134 of the lever 130 downward, and bringing the second end 142 of the lever 130 upward. This upward motion of the second end 142 of the lever 130 drives the lower jaw mount 140 and lower jaw 148, guided by slot 138, in an upward motion, drawing the upper jaw 146 and the lower jaw 148 together, sandwiching the dunnage product D therebetween. As the upper jaw mount 122 travels downward, the cutting blade drive gear 152 travels down with the upper jaw mount 122. The cutting blade drive gear 152 is not rotating at this time and is prevented from rotating by the cutting blade lock 171 described in detail hereinafter.

Figure 11:
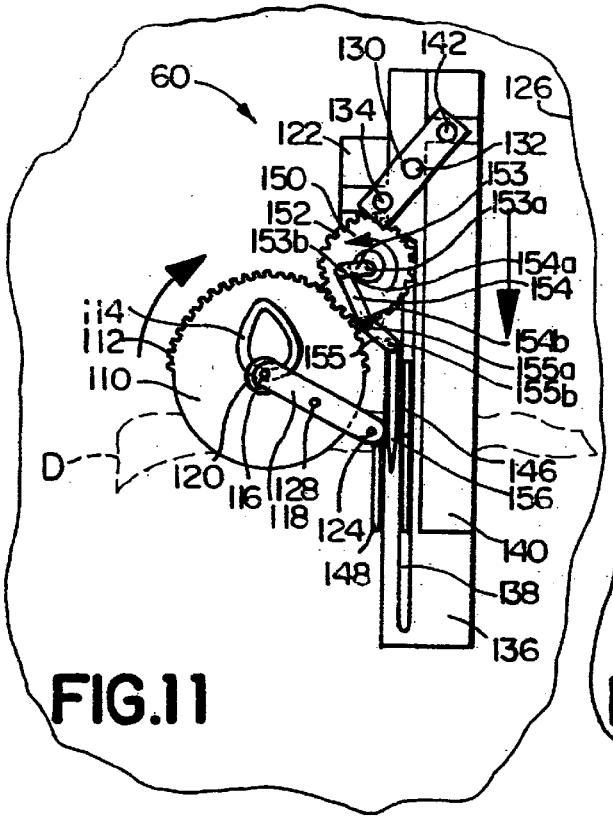
Figure 12:
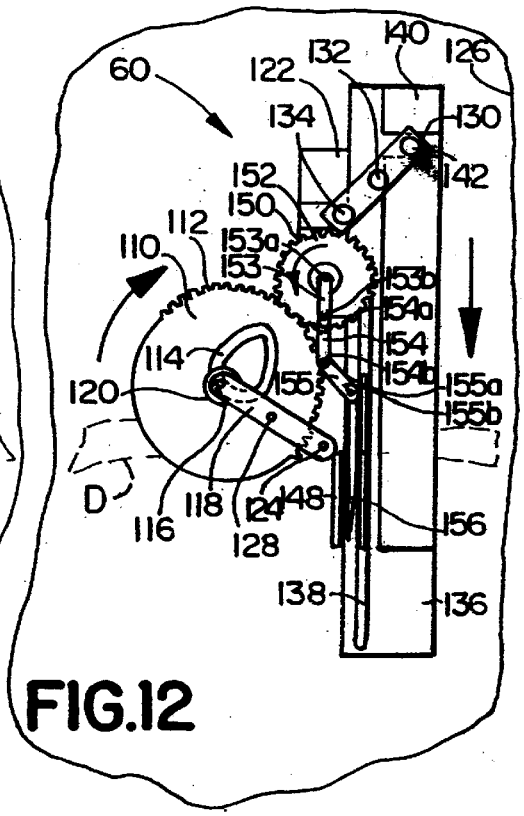

As shown in FIGS. 11 and 12, as the upper jaw 146 and the lower jaw 148 meet, sandwiching dunnage product D which is disposed between the upper jaw 146 and the lowerjaw 148, the teeth 112 of the rotating cam 110 engage the teeth 152 of cutting blade drive gear 150, rotating the cutting blade drive gear 150 in a counterclockwise direction. The cam 110 is still rotating in a clockwise direction, but the cam slot 114 is designed such that, at this time, cam arm 118 is not rotating, and as a result, the upperjaw 146 and the lower jaw 148 are stationary. The rotation of cutting blade drive gear 150 also rotates pivoting cutting blade drive shaft 154 in a counterclockwise direction and downward about the second link 155, driving the cutting blade 156 downward from the open position against the bias of the spring, through the dunnage material D, to a cutting position, cutting the dunnage material D, as shown in the sequence of FIGS. 11 and 12.

Figure 13:
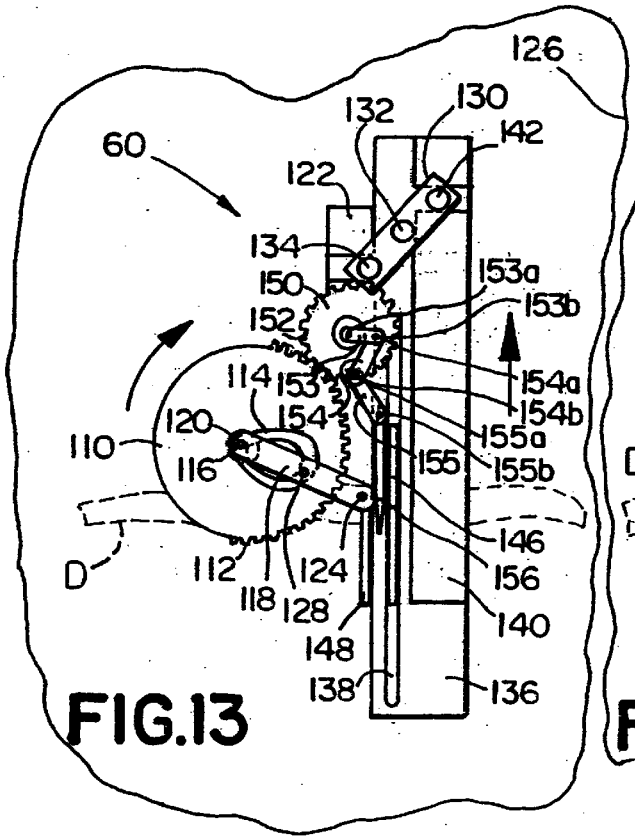

After the cutting blade 156 has cut the dunnage product D, the teeth 112 on the cam 110, still engaged with the teeth 152 on the cutting blade drive gear 150, still rotate the cutting blade drive gear 152 in a counterclockwise direction, drawing the cutting blade shaft 154 upward and retracting the cutting blade 156 to the open position with the assistance of the cutting blade 156 spring, as shown in FIG. 13.

Figure 15:
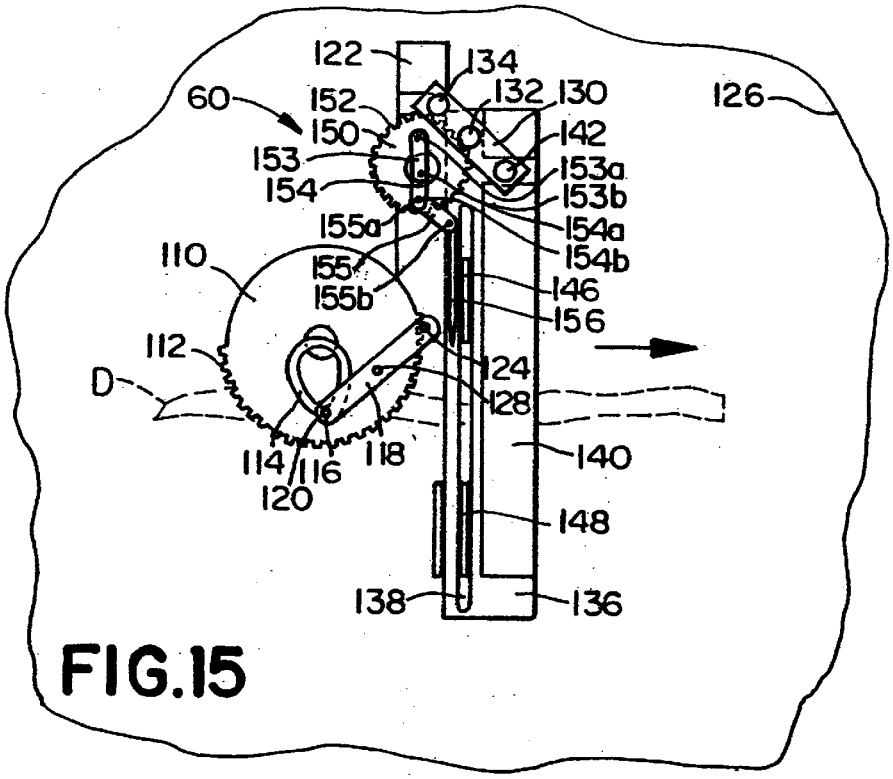

As shown in FIGS. 14 and 15, after the cutting blade 156 has been retracted and the cutting blade drive gear 150 has disengaged from the cam 110, and with the cutting motor 68 still driving the cam 110 in the clockwise direction, the interaction of the cam slot 114 and the cam follower 116 reverses the rotation of cam arm 118 to a counterclockwise rotation, thereby drawing the upper jaw 146 up and the lower jaw 148 down, away from each other against the bias of the spring, releasing the dunnage material D, whereby the whole process can be started over again.

Figure 16:
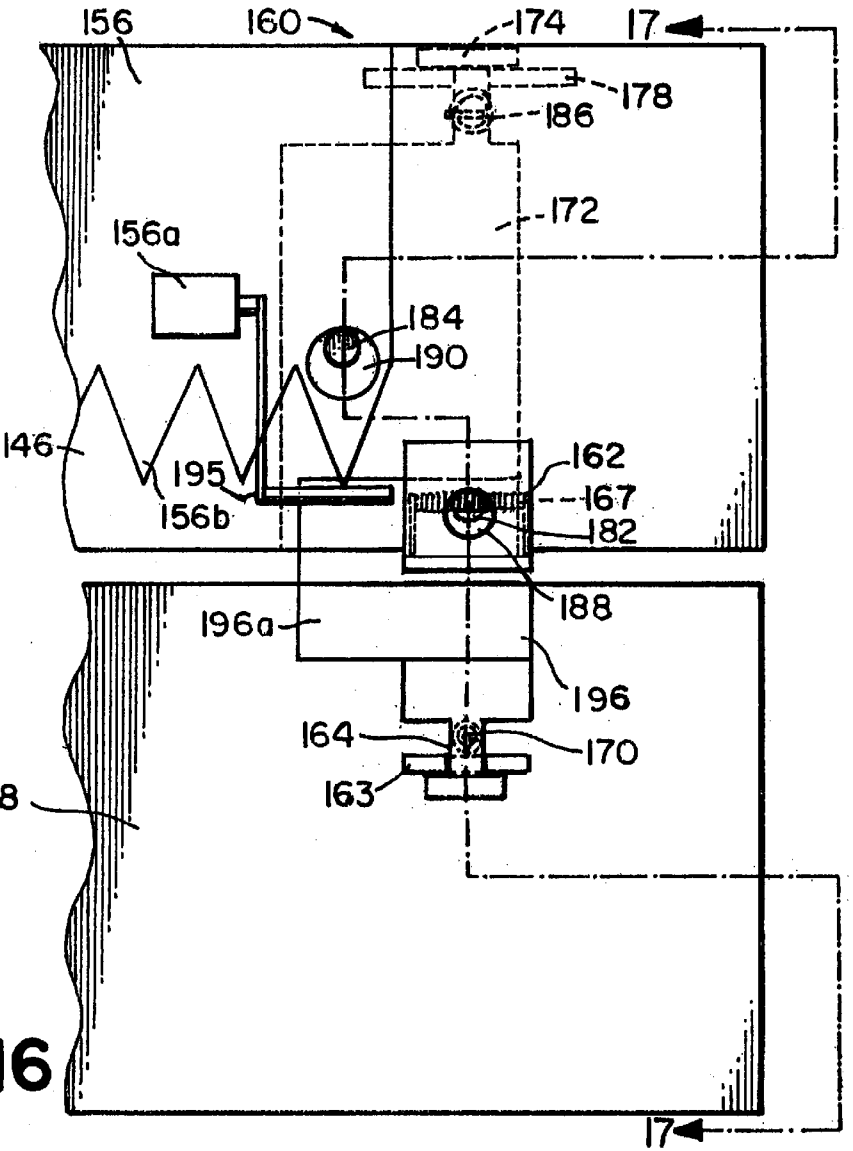
FIG. 16 is a greatly enlarged partial cross-sectional view of the blade lock locking the blade to the upper jaw, taken along line 16—16 of FIG. 4.

Next, referring to FIGS. 16–19, a cutting blade lock apparatus, referred to generally as 160, is described. A generally inverted V-shaped spring biased jaw lock 162 is pivotally mounted to the lower jaw 148 and pivots about the lowermost end 164 of the jaw lock 162 via a pivot mechanism 163. A jaw lock arm 166, fixedly attached to the jaw lock 162, extends from the upper end of the jaw lock 162 over the top of the lower jaw 148. The jaw lock 162 and jaw lock arm 166 are biased toward the lower jaw 148 by a spring 170 housed within a bore 173 in the lower jaw 148. The jaw lock arm 166 is engageable with the upper jaw 146 to releasably lock the upper jaw 146 to the lower jaw 148 when the upper and lower jaws 146, 148 are in the second, closely spaced position, as described in more detail below. A release plate 196 is pivotally mounted beneath the jaw lock 162 and is biased to the left by a coil spring 167 disposed between the release plate 196 and the jaw lock 162. As shown in FIG. 16, the release plate 196 has about twice the width of the jaw lock 162 and has an extension portion 196*a* which extends beyond the jaw lock 162 for reasons described hereinafter.

A cutting blade lock, generally denoted as 171, releasably locks the cutting blade 156 to the upperjaw 146 in the open position when the upper and lower jaws 146, 148 are in the spaced apart position while the dunnage D is being formed. The cutting blade lock 171 unlocks the cutting blade 156 as described below to permit the cutting blade 156 to move to the cutting position in response to the upper and lower jaws 146, 148 moving to the second, closely spaced position where the paper P is sandwiched between the upper and lower jaws 146, 148. A cutting blade lock arm 172 has a first end 174 pivotally attached to the upper jaw 146 at the distal end 176 of a cross bar 178 extending perpendicularly from the upper jaw 146, and a second end 180. The second end 180 has a lower lock pin 182 and an upper lock pin 184 extending therefrom. A blade lock spring 186, located between the upper jaw 146 and the cutting blade lock arm 172, biases the lower and upper lock pins 182, 184 toward the cutting blade 156. A lower slot 188 and an upper slot 190 are located within upper jaw 146 through which the lower lock pin 182 and the upper lock pin 184 normally protrude, respectively. The upper lock pin 184, which is fixedly attached to the cutting blade lock arm 172, protrudes through the second slot 190 to the cutting blade side of the upper jaw 146 and into a hole 192 in the cutting blade 156 when the upper and lower jaws 146, 148 are in the first, spaced apart position, preventing the cutting blade 156 from moving. A lever 195 is fixedly attached to and extends parallel to the cutting blade 156 via a cantilever shaft 156*a*. The length of the lever 195 is selected such that it only engages the extension portion 196*a* of the release plate 196 and does not extend under the jaw lock 162.

Figure 17:
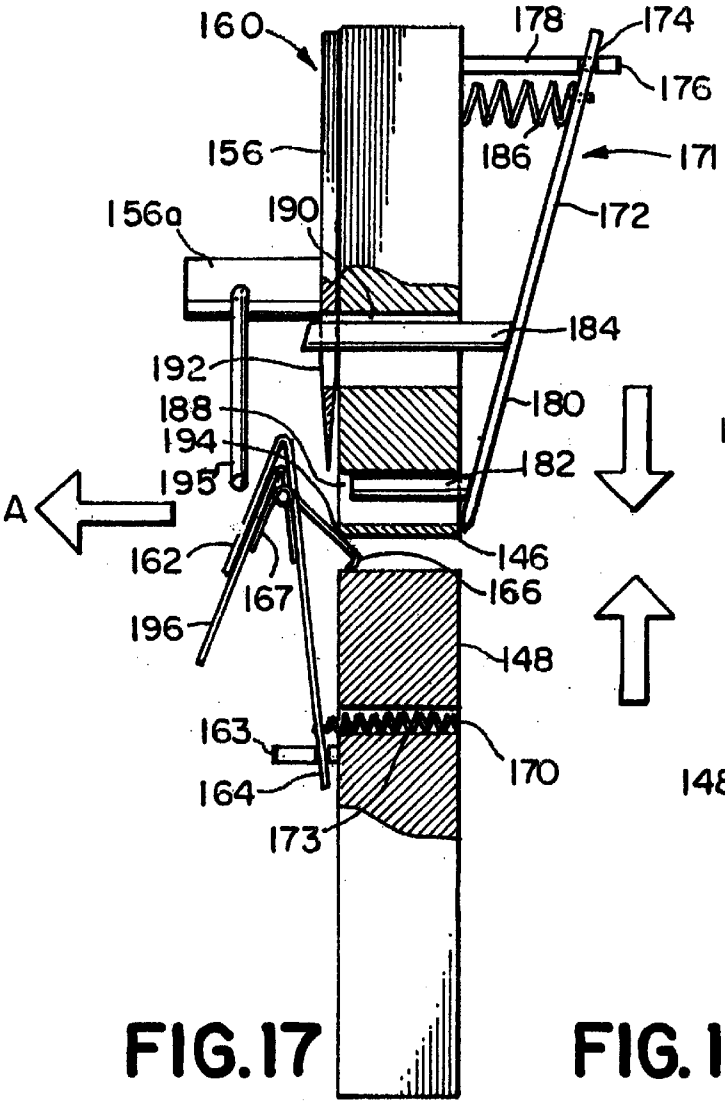
FIG. 17 is a side view, partially in section, of FIG. 16, taken along line 17—17 of FIG. 16.
Figure 18:
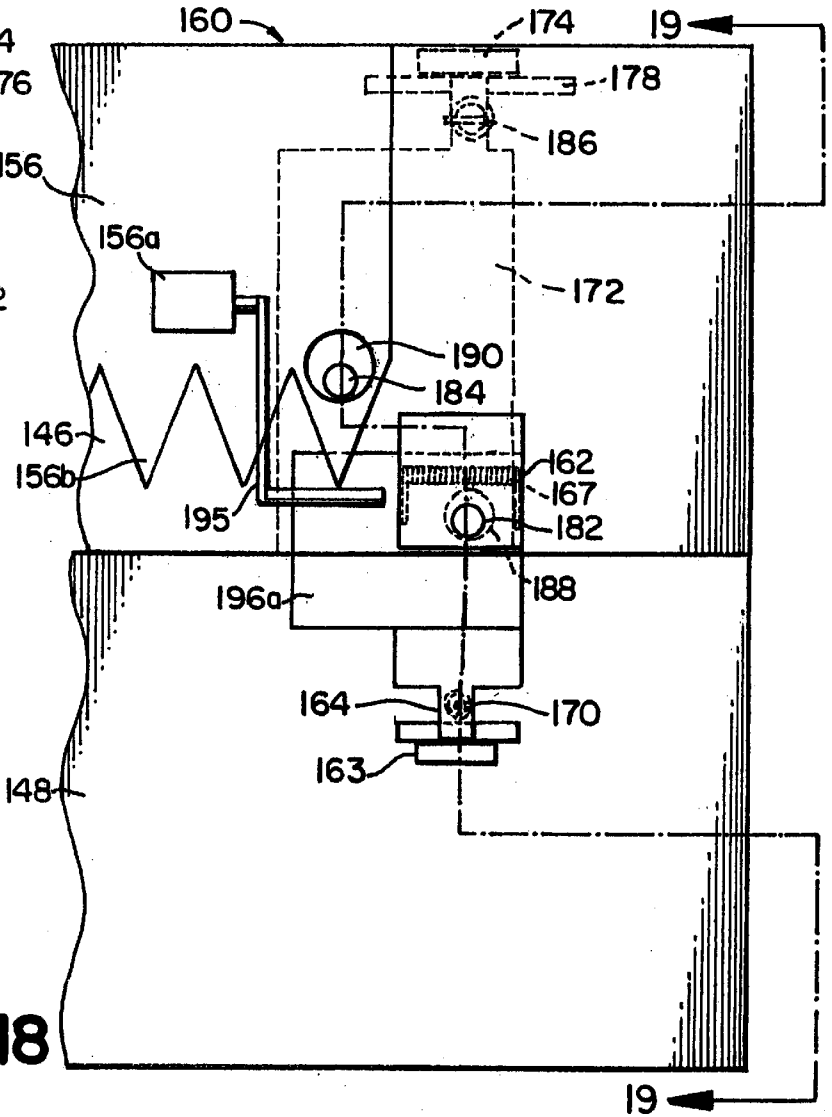
FIG. 18 is a greatly enlarged partial cross-sectional view of the blade having been unlocked from the blade lock, taken along line 16—16 of FIG. 4.

As shown in FIG. 17, the lower lock pin 182 is fixedly attached to the second end 180 of the blade lock arm 172, wherein, when the upper and lower jaws 146, 148 are in the second, closely spaced position, the jaw lock 162 extends into the lower slot 188, moving the lower lock pin 182 to the right and consequently moving the upper lock pin 184 from the upper slot 190 to unlock the blade lock 171. As shown in FIGS. 16 and 18, the cutting blade 156 has a leading cutting edge 156*b* which is serrated.

Figure 19:
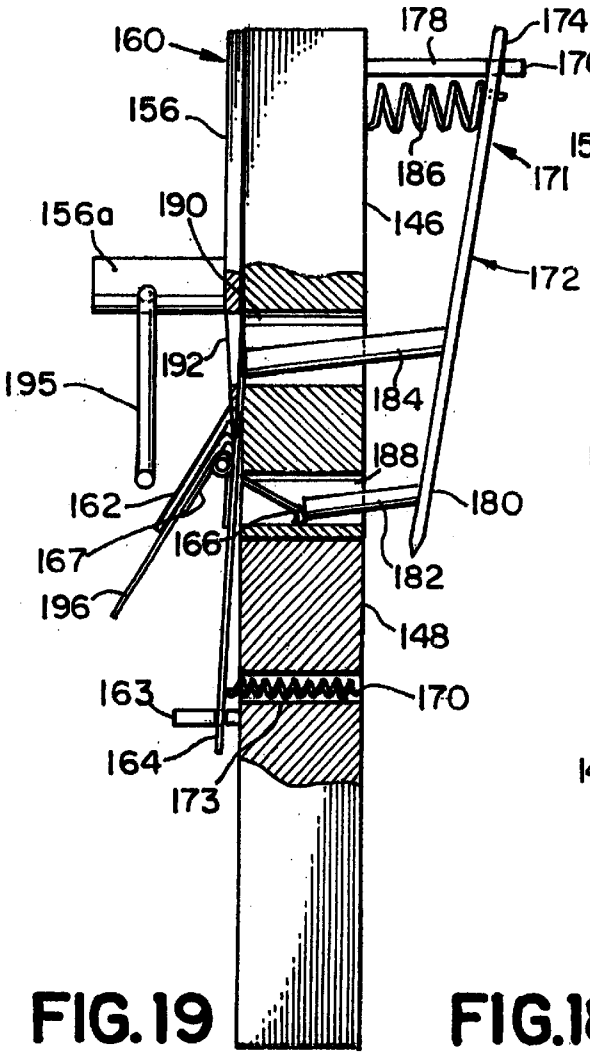
FIG. 19 is a side view, partially in section, of FIG. 18, taken along line 19—19 of FIG. 18.

The operation of the cutting blade lock 171 is now described. As the upper jaw 146 and the lower jaw 148 start to move relative to each other from the first spaced apart position to the second, closely spaced position, as shown in FIGS. 16 and 17, the upper jaw 146 pushes the jaw lock arm 166 away from the lower jaw 148 by a camming action via the jaw lock arm 166 in the direction of arrow A in FIG. 17. When the upper and lower jaws 146, 148 are in the second, closely spaced position, the jaw lock arm 166, biased by spring 167 moves around and over the leading edge 194 of the upper jaw 146. The jaw lock arm 166 then moves to the right as shown in FIG. 19 and extends into the lower slot 188, pushing lower lock pin 182 to the right and thereby locking the upper jaw 146 and lower jaw 148 together. Pushing the lower lock pin 182 to the right also pushes the upper lock pin 184 to the right, releasing the cutting blade 156. The position and strength of the jaw lock spring 170 and the cutting blade lock spring 186 are selected such that the biasing force applied to the jaw lock arm 166 overcomes the biasing force applied to the lower lock pin 182. Only after the upper and lower jaws 146, 148 are locked together does the cutting blade lock 171 unlock the cutting blade 156, as shown in FIGS. 18 and 19. After the cutting blade 156 is unlocked, the cutting blade 156 begins to descend to cut the dunnage D. As the cutting blade 156 descends, the lever 195, which is fixedly mounted on the cutting blade 156, presses the extension portion 196*a* of the release plate 196, which is pivotally mounted to the jaw lock 162, toward the lower jaw 148 so the cutting blade 156 can continue descending to cut the dunnage D. Once the lever 195 passes the release plate 196 as the cutting blade 156 is descending, the release plate 196 snaps away from the lower jaw 148 because of the coil spring 167 disposed between the release plate 196 and the jaw lock 162. The cutting blade 156 fully descends, completely cutting the dunnage D. The cutting blade 156 then begins retracting to its upper position. As the cutting blade 156 is retracting from the cutting position to the open position, the lever 195 catches the inside of the extension portion of the release plate 196 and begins to pull the jaw lock arm 166 away from the lowerjaw 148 to begin unlocking the jaw lock 162. As the jaw lock 162 is pulled away from the lower jaw 148, the blade lock 171 begins returning to its original position until the upper lock pin 184 engages the cutting blade hole 192. When the cutting blade 156 is fully retracted, the lever 195 passes by the upper end of the extension portion 196*a* of the release plate and the blade lock 171 locks the cutting blade 156 into its locked position. When the jaw lock 162 is totally retracted by the interaction of the lever 195 and the release plate 196, the upper and lower jaws 146, 148 are unlocked. When the jaws 146, 148 are unlocked, the upper jaw and lower jaws 146, 148 separate. When the lever 195 passes the upper end of the extension portion 196*a* of the release plate 196, the jaw lock 162 releases from the lever 195. The jaw lock spring 170 snaps the jaw lock 162 back to its original position on top of the lower jaw 148.

Referring back to FIG. 4, the newly cut dunnage paper D then drops into the container C to pad the container C to protect whatever item has been placed in the container C. The container C is located on a conveyer V which conveys the container C to the conversion machine 10 to load the dunnage D, and then convey the container C away for shipping.

Although, in the preferred embodiment, both the upper jaw 146 and the lower jaw 148 each move between the first, spaced apart position and the second, closely spaced position, it would be understood by those skilled in the art from this disclosure that one of the upper and lower jaws 146, 148 can be fixedly mounted to the jaw mount frame 136 and the other can move between the first, spaced apart position and the second, closely spaced position, and still perform the same function.

Similarly, the present invention is not limited to the specific cutting blade lock apparatus 160 or the camming mechanism used to control the movement of the upper and lower jaws 146, 148. For instance, the upper jaw 146, lower jaw 148, cutting blade 156 could be separately controlled by solenoid activated pistons (not shown) that include electrical safety interlocks without departing from the spirit and scope of the invention.

The operation of the cutting blade locking apparatus 160 is now described. The paper P, having been converted into dunnage D, is disposed between the upper jaw 146 and the lower jaw 148. When the operator O releases the foot switch 66, the drive motor 56 stops and the cutting motor 68 is activated as previously described herein. The upper jaw 146 and the lower jaw 148 are drawn together, sandwiching the dunnage D between the upper and lower jaws 146, 148. In response to the upper jaw 146 and the lower jaw 148 sandwiching the dunnage D therebetween, the cutting blade 156 is unlocked from its locked, open position. The cutting blade 156 moves from the open position to the cutting position, severing the dunnage D in the process. After the dunnage D is severed, the cutting blade 156 returns to the open position. The cutting blade 156 is then locked into the open position and the upper jaw 146 is separated from the lower jaw 148. Preferably, the upper jaw 146 is locked to the lower jaw 148 between the time that the dunnage D is sandwiched between the upper and lowerjaws 146, 148 and the time that the cutting blade 156 moves from the open position to the cutting position.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

What is claimed is:

1. An apparatus for rotatably supporting a paper roll core on a mandrel mount, the paper roll core having a first and second end, a mandrel handle extending into the first end, the mandrel handle being rotatably fixed to the paper roll core, a first jam cleat being biased against the mandrel handle to apply friction to the mandrel handle, the first jam cleat being mounted on the mandrel mount and being pivotable about a first pintle positioned on the mandrel mount and the first jam cleat, the first jam cleat applying a predetermined amount of friction against the mandrel handle, the predetermined amount of friction limiting backlash against the mandrel handle.

2. The apparatus according to claim 1, wherein the first jam cleat further comprises a gripping friction pad in engagement with the mandrel handle.

3. The apparatus according to claim 1, further including a second jam cleat mounted on the mandrel mount and being pivotable about a second pintle positioned on the mandrel mount and the second jam cleat, the second jam cleat being biased against the mandrel handle to apply friction to the mandrel handle, the first and second jam cleats being biased in opposite directions and toward each other such that when the mandrel handle is removed, the first and second jam cleats engage each other.

4. The apparatus according to claim 3, wherein the first and second jam cleats each comprise a gripping friction pad for engagement with the mandrel handle.

* * * * *